US005206130A

United States Patent [19]

Shimada et al.

[11] Patent Number: 5,206,130

[45] Date of Patent: Apr. 27, 1993

[54] CYAN COUPLER, CYAN IMAGE FORMING METHOD USING THE SAME AND SILVER HALIDE COLOR PHOTOGRAPHIC MATERIAL CONTAINING THE SAME

[75] Inventors: Yasuhiro Shimada; Yoshio Ishii, both of Kanagawa, Japan

[73] Assignee: Fuji Photo Film Co., Ltd., Kanagawa, Japan

[21] Appl. No.: 788,416

[22] Filed: Nov. 6, 1991

[30] Foreign Application Priority Data

Nov. 6, 1990 [JP] Japan ..... 2-300306

[51] Int. Cl.[5] ..... G03C 7/38

[52] U.S. Cl. ..... 430/558; 430/384; 430/385

[58] Field of Search ..... 430/558, 384, 385

[56] References Cited

U.S. PATENT DOCUMENTS 4,728,598 3/1988 Bailey et al. ..... 430/558

4,910,127 3/1990 Sakaki et al. ..... 430/546

*Primary Examiner*—Lee C. Wright

*Attorney, Agent, or Firm*—Sughrue, Mion, Zinn, Macpeak & Seas

[57] ABSTRACT

Disclosed is a silver halide color photographic material comprising a support thereon having at least one silver halide emulsion layer containing at least one cyan coupler of the general formula (I):

(I)

where

R represents a group capable of being an imidazo[1,2-b]pyrazole skeletal substituent;

EWG represents an electron-attracting substituent which does not substantially split off from the formula on reaction of the coupler with an oxidation product of an aromatic primary amine developing agent;

X represents a hydrogen atom or a releasable group which splits off from the formula on reaction of the coupler with an oxidation product of an aromatic primary amine developing agent; and n represents an integer of from 1 to 7, providing an excellent cyan dye and cyan image having satisfactory absorption characteristic and color fastness.

7 Claims, 2 Drawing Sheets

CYAN COUPLER, CYAN IMAGE FORMING METHOD USING THE SAME AND SILVER HALIDE COLOR PHOTOGRAPHIC MATERIAL CONTAINING THE SAME

FIELD OF THE INVENTION

The present invention relates to a photographic cyan coupler with improved color reproducibility, a cyan image forming method using such a coupler and a silver halide color photographic material containing the coupler.

BACKGROUND OF THE INVENTION

A photographic system comprising reacting an aromatic primary amine developing agent, which has been oxidized with exposed silver halide acting as an oxidizing agent, and a coupler to form an indophenol, indaniline, indamine, azomethine, phenoxazine, phenazine or the like dye to produce a color image is well known. In such a photographic system, a subtractive color producing process is employed in which a color image is formed of yellow, magenta and cyan dyes.

Hitherto, phenols or naphthols have been employed as cyan couplers. However, cyan dyes formed from such couplers have unsatisfactory spectral absorption characteristics, heat resistance, moisture resistance and light resistance. Various couplers with improved properties have heretofore been developed.

For instance, U.S. Pat. No. 4,728,598 discloses novel couplers, but the dyes produced therefrom have a broad color hue range in which the maximum absorption peak wavelength falls between 538 nm and 602 nm. The disclosed novel couplers are therefore not practical. In addition, it has also been found that the images obtained from the couplers have an extremely poor color fastness.

The present inventors have earnestly studied imidazo[1,2-b]pyrazoles and have surprisingly found that introduction of a perfluoroalkyl group into the 2-position of the compounds provides cyan couplers with excellent properties.

SUMMARY OF THE INVENTION

A first object of the present invention is to provide a cyan coupler having an excellent absorption characteristic, a method of forming a cyan image with an improved color hue by the use of such a cyan coupler, and a silver halide color photographic material of containing the coupler.

A second object of the present invention is to provide a cyan coupler with excellent color forming properties, a cyan image forming method using such a cyan coupler, and a silver halide color photographic material of containing the coupler.

A third object of the present invention is to provide a cyan coupler capable of forming a dye with excellent light fastness, a cyan image forming method using such a cyan coupler, and a silver halide color photographic material of containing the coupler.

The objects of the present invention are attained by a cyan coupler of the general formula (I):

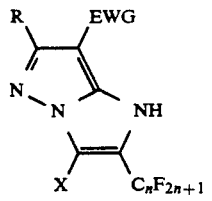

(I)

where

R represents a group capable of being an imidazo[1,2 b]pyrazole skeletal substituent;

EWG represents an electron-attracting substituent which does not substantially split off from the formula by reaction of the coupler with an oxidation product of an aromatic primary amine developing agent;

X represents a hydrogen atom or a releasable group which splits off from the formula by reaction of the coupler with an oxidation product of an aromatic primary amine developing agent; and n represents an integer of from 1 to 7.

The present invention also provides a method of forming a cyan image comprising the coupling reaction of a cyan coupler of formula (I) and an oxidation product of an aromatic primary amine developing agent.

The present invention further provides a silver halide color photographic material containing a cyan coupler of formula (I).

Figure 1:
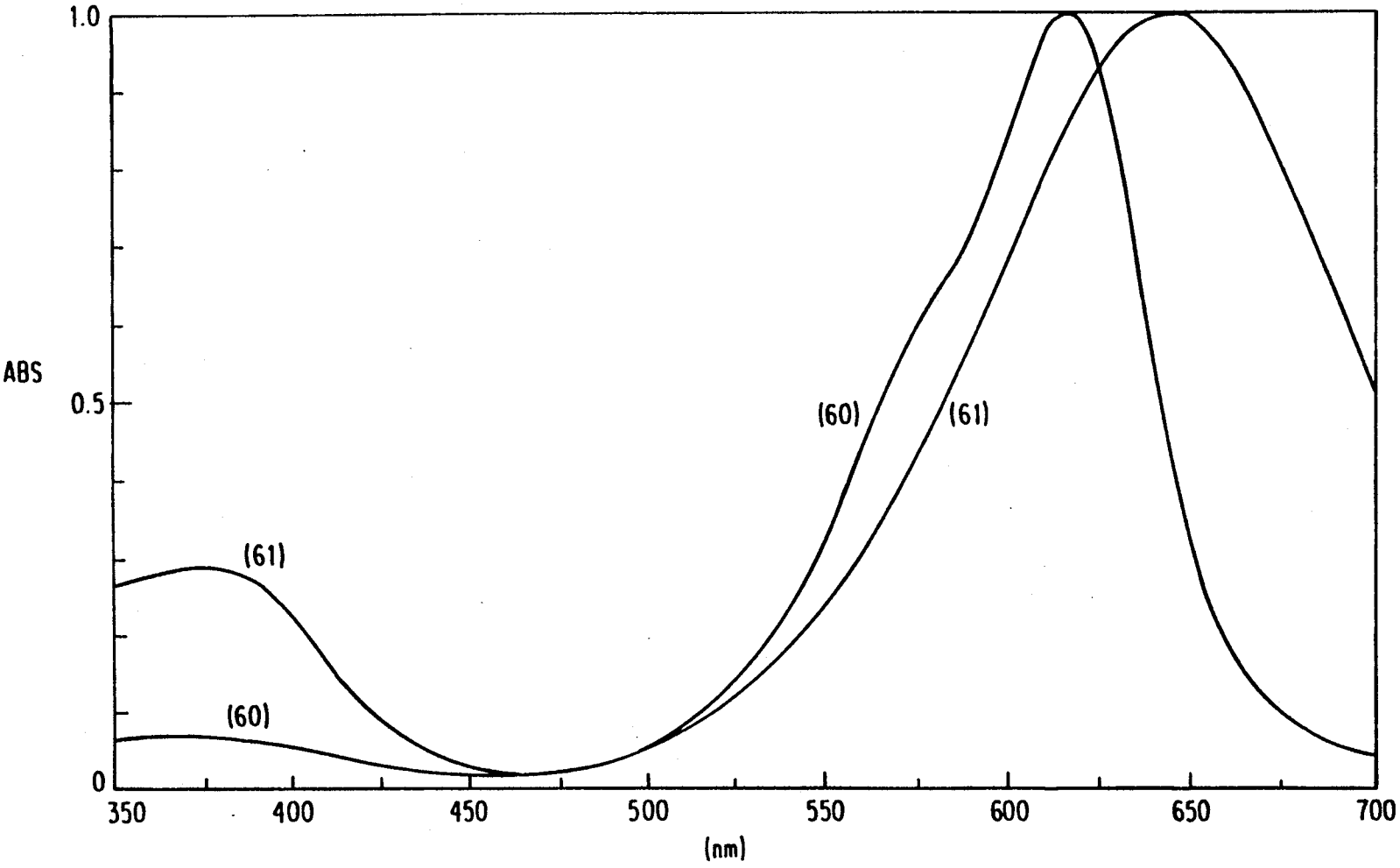
FIG. 1 shows absorption wave forms (in ethyl acetate) of a cyan dye (60) formed from a coupler (15) of the present invention and a cyan dye (61) formed from a known phenol coupler, as described in Example 1.

In the drawings, the abscissa indicates the wavelength and the ordinate indicates the absorption density (standardized to 1.0)

DETAILED DESCRIPTION OF THE INVENTION

The coupler of formula (I) of the present invention reacts with an oxidation product of an aromatic primary amine developing agent by a coupling reaction to produce a dye, which preferably has a maximum absorption peak wavelength within the range of from 605 to 740, especially preferably from 605 to 700 nm.

Cyan couplers of formula (I) of the present invention are explained in greater detail hereunder.

In formula (I), R represents a 5 to 8-membered heterocyclic group having at least one of hetero atoms, such as N, S, O, (e.g., 2 furyl, 2-thienyl, 2-pyrimidyl, 2-benzothiazolyl), a cyano group, an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-t-butylphenoxy), a heterocyclic-oxy group (e.g., 2-benzimidaozlyloxy), an aliphatic or aromatic acyloxy group (e.g., acetoxy, hexadecanoyloxy), a carbamoyloxy group (e.g., N-ethylcarbamoyloxy), a silyloxy group (e.g., trimethylsilyloxy), an aliphatic or aromatic sulfonyloxy group (e.g,. dodecylsulfonyloxy), an aliphatic or aromatic acylamino group (e.g., acetamido, benzamido, tetradecanamido, α-(2,4-di-t-amylphenoxy)butyramido, 2,4-di-t-amylphenoxyacetamido, α-{4-(4-hydroxyphenylsulfonyl)phenoxy}decanamido, isopentadecanamido), an anilino group (e.g., phenylamino, 2-chloroanilino, 2-chloro-5-tetradecanamidanilino, 2-chloro-5-dodecyloxycarbonylanilino, N-acetylanilino, 2-chloro-5-{α-(2-t-butyl-4-hydroxyphenoxy)-dodecanamido}anilino), an ureido group (e.g., phenylureido, methylureido, N,N-dibutylureido), an imido group (e.g., N-succinimido, 3-benzylhydantoinyl, 4-(2-ethylhexanoylamino)phthalimido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecanamidophenylthio), a heterocyclic-thio group (e.g., 2-benzothiazolylthio), an alkoxycarbonylamino group (e.g., methoxycarbonylamino, tetradecyloxycarbonylamino), an aryloxycarbonylamino group (e.g., phenoxycarbonylamino, 2,4-di-tert-butylphenoxycarbonyl amino), a sulfonamido group (e.g., methanesulfonamido, hexadecansulfonamido, benzenesulfonamido, p-toluenesulfonamido, octadecansulfonamido, 2-methyloxy-5-t-butylbenzenesfulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)-propyl}carbamoyl), an aliphatic or aromatic acyl group (e.g., acetyl, (2,4-di-tert-amylphenoxy)acetyl, benzoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), an aliphatic or aromatic sulfonyl group (e.g., methanesulfonyl, octanesulfonyl, benzenesulfonyl, toluenesulfonyl), a sulfinyl group (e.g,. octanesulfinyl, dodecylsulfinyl, phenylsulfinyl), an alkoxycarbonyl group (e.g., methoxycarbonyl, butyloxycarbonyl, dodecyloxycarbonyl, octadecyloxycarbonyl), an aryloxycarbonyl group (e.g., phenyloxycarbonyl, 3-pentadexyloxycarbonyl), or an aromatic group having from 6 to 36 carbon atoms (e.g., phenyl, naphthyl). Where R is an aromatic group which includes monocyclic and bicyclic group, it may be substituted with one or more substituents selected from those mentioned above. R has a total carbon number of 1 to 50, preferably 1 to 36.

The "aliphatic group" as referred to herein indicates a linear, branched or cyclic aliphatic hydrocarbon group, which may be saturated or unsaturated and may be substituted or unsubstituted, and includes, for example, an alkyl group, an alkenyl group and an alkynyl group. Specific examples of aliphatic groups are methyl, ethyl, butyl, dodecyl, octadecyl, eicosenyl, iso-propyl, tert-butyl, tert-octyl, tert-dodecyl, cyclohexyl, cyclopentyl, allyl, vinyl, 2-hexadecenyl, 3-(2,4-di-t-amylphenoxy)propyl, 2-dodecyloxyethyl, 3-phenoxypropyl, 2-hexylsulfonylethyl, benzyl, trifluoromethyl, and propargyl groups.

In formula (I), EWG represents an electron-attracting substituent or atom which does not substantially split off from the formula on reaction of the coupler with an oxidation product of an aromatic primary amine developing agent, and it has a Hammett's substituent constant $\sigma_p$ of more than 0.

The value of Hammett's substituent constant $\sigma_p$ as referred to herein is the constant mentioned in Hansch, C. Leo et al (e.g., *J. Med. Chem.*, 16, 1207 (1973); ibid., 20, 304 (1977)).

For example, EWG represents a carbamoyl group (e.g., carbamoyl, methylcarbamoyl, N-phenylcarbamoyl, N-(2-chloro-5-tetradecyloxycarbonylphenyl)carbamoyl, N,N-diethylcarbamoyl, N-(2,4-dichlorophenyl)carbamoyl, N-(2-chloro-5-hexadecansulfonamidophenyl)carbamoyl), an alkoxycarbonyl group (e.g., methoxycarbonyl, ethoxycarbonyl, butoxycarbonyl, dodecyloxycarbonyl, 2-ethylhexyloxycarbonyl), a phosphono group, an aryloxycarbonyl group (e.g., phenoxycarbonyl, 1-naphthyloxycarbonyl), an aliphatic or aromatic acyl group (e.g., benzoyl, formylacetyl, 4-chlorobenzoyl, 2,4-dichlorobenzoyl), an aliphatic or aromatic sulfonyl group (e.g., methanesulfonyl, dodecanesulfonyl, trifluoromethanesulfonyl, difluoromethanesulfonyl, toluenesulfonyl, benzenesulfonyl, 2-butoxy-5-t-octylphenylsulfonyl), a phosphoryl group (e.g., dimethoxyphosphoryl), an aliphatic or aromatic sulfamoyl group (e.g., N-ethylsulfamoyl, N-butylsulfamoyl, N-phenylsulfamoyl, N,N-diethylsulfamoyl, N,N-dipropylsulfamoyl), a nitro group, a cyano group, a fluoroalkyl group (e.g., trifluoromethyl, heptafluoropropyl), a sulfinyl group (e.g., methanesulfinyl, benzenesulfinyl, naphthalenesulfinyl), or an aromatic group (e.g., phenyl, 2-chlorophenyl, 4-acetamidophenyl). EWG has a total carbon number of 1 to 50, preferably 1 to 36.

Preferably, EWG is an electron-attracting group having a $\sigma_p$ value of 0.30 or more.

Examples of electron-attracting groups having a $\sigma_p$ value of 0.30 or more for EWG include a cyano group, a nitro group, an aliphatic or aromatic acyl group, a carbamoyl group, a phosphono group, an alkoxycarbonyl group, a phosphoryl group, an aliphatic or aromatic sulfamoyl group, an aliphatic or aromatic sulfonyl group, and a fluoroalkyl group.

Most preferably, EWG is a cyano group, a carbamoyl group, an alkoxycarbonyl group, an aliphatic or aromatic acyl group, an aliphatic or aromatic sulfonyl group, or a sulfamoyl group.

In formula (I), X represents a hydrogen atom or a releasable group or atom (as simply referring to releasable group hereinafter, which includes releasable atoms), which splits off from the formula on reaction of the coupler with an oxidation product of an aromatic primary amine developing agent. Examples of releasable groups for X include a halogen atom; an aromatic azo group; a group bonded to an aliphatic group, an aromatic group, a heterocyclic group, an aliphatic, aromatic or heterocyclic sulfonyl group, or an aliphatic, aromatic or heterocyclic carbonyl group, via an oxygen, nitrogen, sulfur or carbon atom; or a heterocyclic group bonded to the coupling position of the formula via a nitrogen atom of the group. The aliphatic, aromatic or heterocyclic group moiety in the releasable group may optionally be substituted by one or more substituents such as those hereinabove described for R. Where the moiety is substituted by two or more substituents, they may be same or different, and the substituents may further be substituted by other substituent(s) such as those also described for R. X has a total carbon number of 1 to 36, preferably 1 to 20.

Specific examples of the releasable groups are a halogen atom (e.g., fluorine, chlorine, bromine), an alkoxy group (e.g., ethoxy, dodecyloxy, methoxyethylcarbamoylmethoxy, carboxypropoxy, methylsulfonylethoxy), an aryloxy group (e.g., 4-chlorophenoxy, 4-methoxyphenoxy, 4-carboxyphenoxy), an acyloxy group (e.g., acetoxy, tetradecanoyloxy, benzoyloxy), an aliphatic or aromatic sulfonyloxy group (e.g., methanesulfonyloxy, toluenesulfonyloxy), an acylamino group (e.g., dichloroacetylamino, heptafluorobutyrylamino), an aliphatic or aromatic sulfonamido group (e.g., methanesulfonamido, ptoluenesulfonamido), an alkoxycarbonyloxy group (e.g., ethoxycarbonyloxy, benzylcarbonyloxy), an aryloxycarbonyloxy group (e.g., phenoxycarbonyloxy), an aliphatic, aromatic or heterocyclic thio group (e.g., ethylthio, 2-carboxyethylthio, phenylthio, tetrazolylthio), a carbamoylamino group (e.g., N-methylcarbamoylamino, N-phenylcarbamoylamino), a 5-membered or 6-membered nitrogen-containing heterocyclic group (e.g., imidazolyl, pyrazolyl, triazolyl, 1,2-dihydro-2-oxo-1-pyridyl), an imido group (e.g., succinimido, hydantoinyl), an aromatic azo group (e.g., phenylazo), and a carboxyl group. The releasable groups may optionally be substituted by one or more substituents selected from those described for R. X may also be a releasable group bonded to the formula via a carbon atom. Examples of such releasable groups are residues of bis-type couplers obtained by condensation of 4-equivalent couplers with aldehydes or ketones. The releasable group for use in the present invention can contain a photographically useful group such as a development inhibitor or a development accelerator.

Couplers of formula (I) can be used as either the so-called coupler-in-emulsion type couplers which are incorporated into silver halide color photographic materials or the so-called coupler-in-developer type couplers which are incorporated into color developers. Where they are used as coupler-in-emulsion type couplers, at least one of R, EWG and X has a total carbon number of from 10 to 50.

In formula (I), n represents an integer of from 1 to 7, and it is especially preferably an integer of form 1 to 3.

Specific examples of cyan couplers of formula (I) of the present invention are described below, but the present invention is not to be construed as being limited to these examples.

(1)

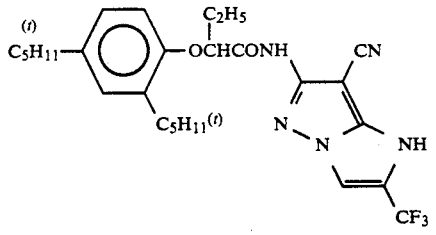

(2)

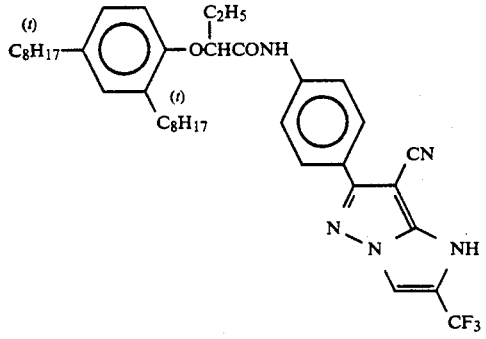

-continued (3)

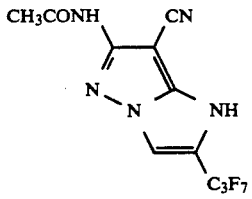

(4)

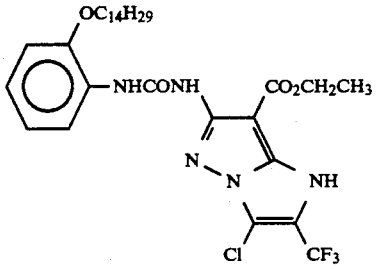

(5)

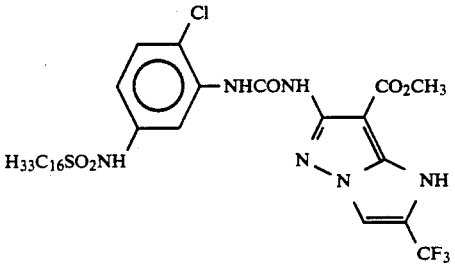

(6)

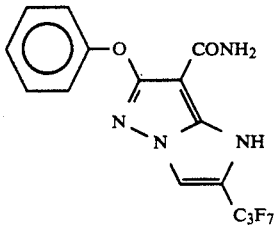

(7)

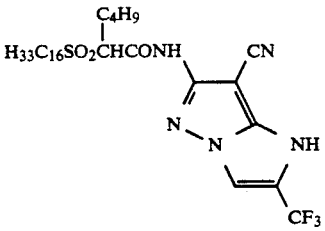

(8)

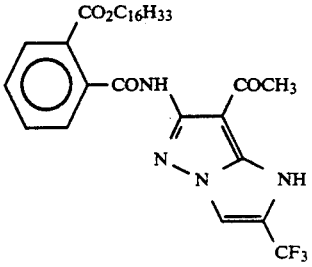

-continued
(9)
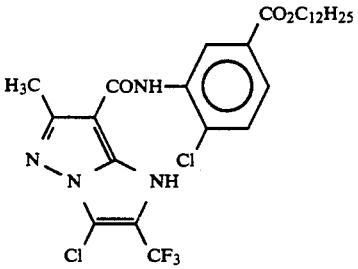
(10)
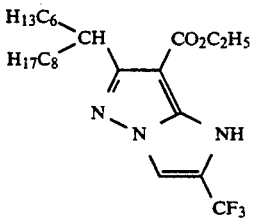
(11)
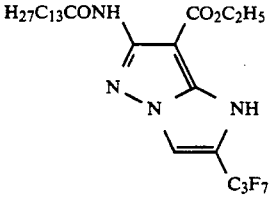
(12)
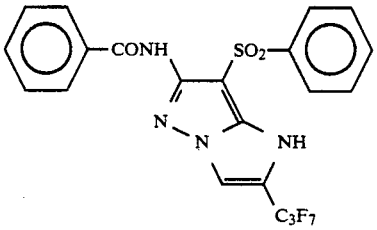
(13)
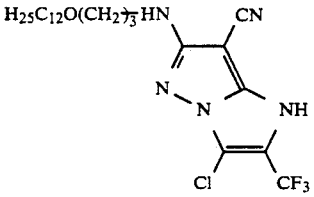
(14)
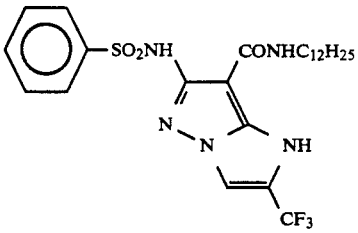
(15)
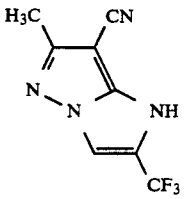
-continued
(16)
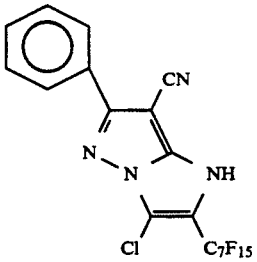
(17)
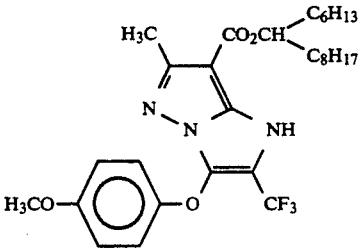
(18)
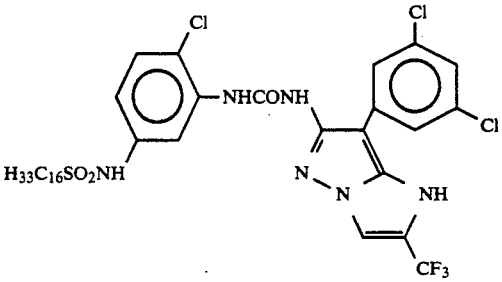
(19)
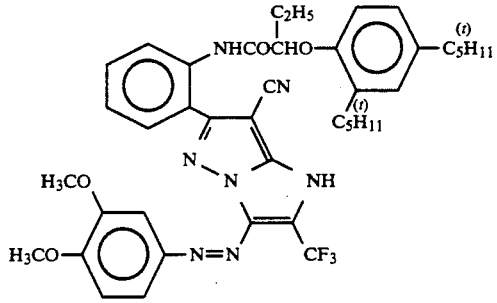
(20)
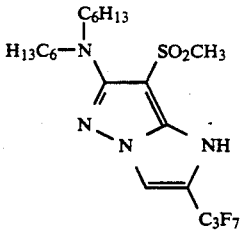
(21)
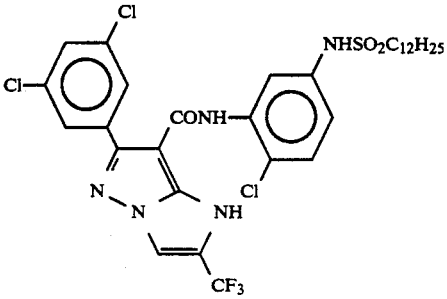

-continued (22)

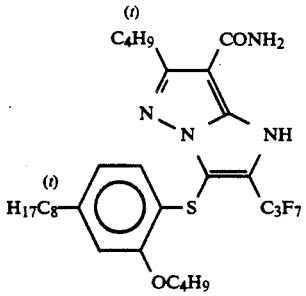

(23)

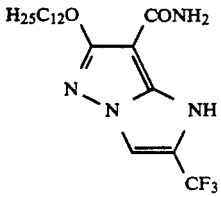

(24)

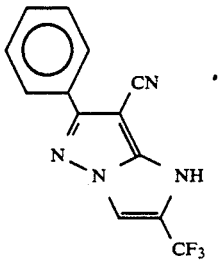

(25)

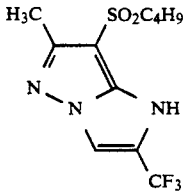

(26)

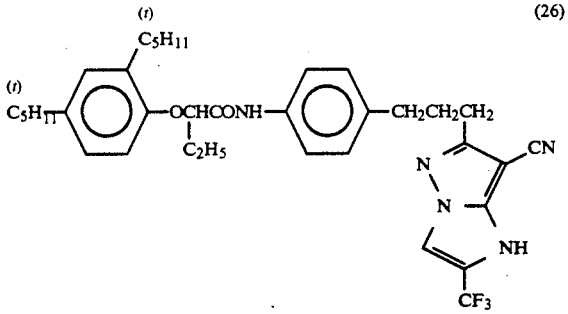

Cyan couplers of formula (I) of the present invention can be prepared using known methods and known starting materials. For instance, the starting materials and methods described in U.S. Pat. No. 4,728,598, *J. Heterocycl. Chem.*, 1979, 16, 1109, and R. H. Wiley, Ed. *Pyrazoles, Pyrazolines, Indazoles and Condensed Rings*, (Interscience, New York, 1967), as well using analogous methods described in the literature referred to in these publications can be employed. For introduction of the releasable group into the compounds, reference can be made to the disclosures of U.S. Pat. Nos. 4,728,598 and 3,926,6631, JP-A-57-70817, U.S. Pat. Nos. 3,419,391, 3,725,067 and 3,227,554, and JP-B-56-45135 and 57-36577. (The terms "JP-A" and "JP-B" as referred to herein mean an "unexamined published Japanese patent application" and an "examined Japanese patent publication", respectively.)

Typical methods of producing couplers of formula (I) of the present invention are described below. Unless otherwise indicated herein, all parts, percents ratios and the like are by weight.

PRODUCTION EXAMPLE 1

Production of Compound (15)

Compound (15) was produced in accordance with the following reaction scheme:

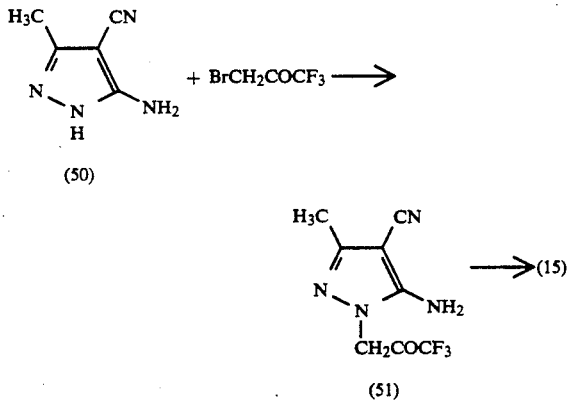

5.0 g of Compound (50) was dissolved in 50 ml of acetonitrile, and 7.7 ml of a 28% methanol solution of sodium methylate was added thereto under an nitrogen atmosphere at room temperature (about 20°-30° C.). After the reaction, an aqueous hydrochloric acid was added to the reaction mixture for neutralization, and 50 ml of ethyl acetate was added thereto for extraction. After the resulting extract was dried, the ethyl acetate was removed therefrom by distillation, and the residue was purified with column chromatography to obtain 4.9 g of Compound (51). The thus obtained Compound (51) was stirred in a water bath at a bath temperature of from 120° to 130° C. for one hour. The reaction residue was then subjected to column chromatography to obtain 1.0 g of Compound (15).

PRODUCTION EXAMPLE 2

Production of Compound (261 )

Compound (26) was prepared in accordance with the following reaction scheme.

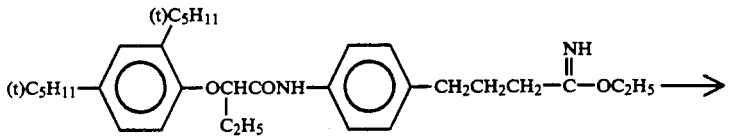

(52)

-continued

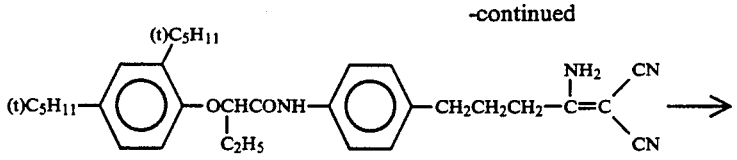

(53)

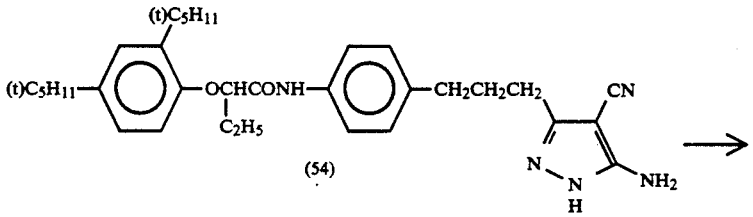

(54)

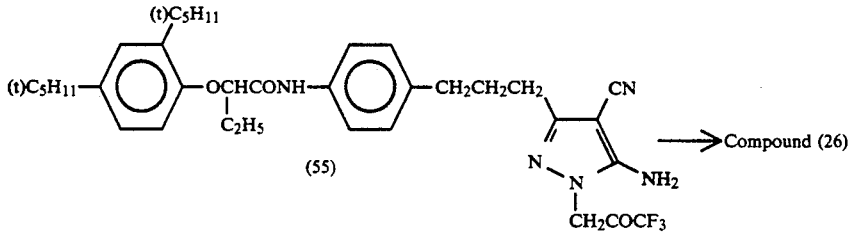

(55)

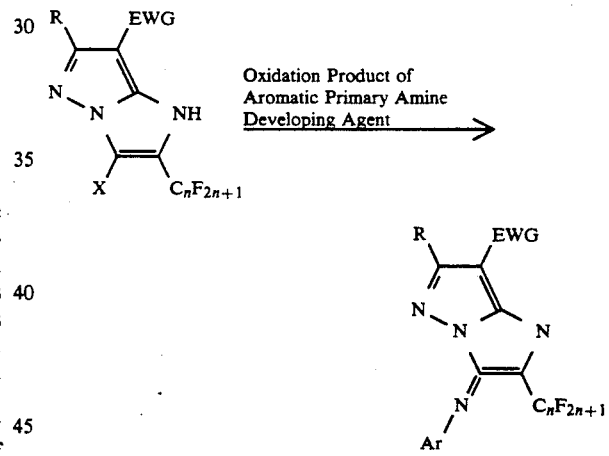

(Ar represents an aromatic group.)

68.6 g of Compound (52) was dissolved in acetic anhydride and malonodinitrile was gradually and dropwise added thereto. After reaction, 200 ml of ethyl acetate was added to the reaction mixture, which was then washed with water. The ethyl acetate extract thus isolated was dried and the ethyl acetate was removed therefrom by distillation under reduced pressure. 100 ml of ethanol was added to the residue for recrystallization, and the crystals thus precipitated out were removed by filtration to obtain 42.3 g of an intermediate product of the intermediate product of Compound (53). Next, 4.7 g of an aqueous 50% hydrazine solution was added to an ethanol solution of 42.3 g of the intermediate product of Compound (53) thus obtained, under reflux. After reaction, ethyl acetate was added to the reaction mixture, which was then washed with water. The ethyl acetate extract was dried and ethyl acetate was removed by distillation under reduced pressure. A mixed solvent of ethyl acetate/hexane (1/1 by vol.) was added to the resulting residue for recrystallization. The crystals thus precipitated out were removed by filtration to obtain 40.8 g of an intermediate product of Compound (54).

Compound (26) was produced from intermediate produce of Compound (54) in the same manner as in Production Example 1.

Other compounds of the present invention can be produced in the same manner as mentioned above.

The cyan dye forming coupler of formula (I) of the present invention reacts with an oxidation product of an aromatic primary amine compound by coupling to produce a cyan dye, for example, in accordance with the reaction procedure set forth below.

Where a coupler of formula (I) of the present invention is incorporated into a silver halide photographic material, at least one layer containing a coupler of formula (I) may be provided on a support. The layer containing a coupler of formula (I) may be a hydrophilic colloid layer on a support. An ordinary color photographic material generally has at least one blue-sensitive silver halide emulsion layer, at least one green-sensitive silver halide emulsion layer and at least one red-sensitive silver halide emulsion layer in this order on a support, but the order of the layers may be varied from this order. If desired, an infrared sensitive silver halide emulsion layer may be substituted for at least one of the light-sensitive emulsion layers. Each of the light-sensitive emulsion layers may contain a silver halide emulsion with a sensitivity to light of the corresponding wavelength range and a color coupler forming a dye which is complementary to light to which the emulsion is sensitive, whereby color reproduction by a subtractive color photographic process is possible in the respective emulsion layers. However, the relationship between the light-sensitive emulsion layer and the color hue of the dye formed from the color coupler therein is not limited to only the above-described arrangement.

The coupler of formula (I) of the present invention is especially preferably incorporated into a red-sensitive silver halide emulsion layer in preparing a color photographic material.

The amount of the coupler of formula (I) present in the photographic material may be from $1\times10^{-3}$ mol to 1 mol, preferably from $2\times10^{-3}$ mol to $3\times10^{-1}$ mol.

Where the coupler of formula (I) of the present invention is soluble in an alkaline aqueous solution, it may be dissolved in an alkaline aqueous solution along with a developing agent and other additives and can be used for coupler-in-developer development to form a color image. In this use, the amount of the coupler of formula (I) present may be from 0.0005 to 0.05 mol, preferably from 0.005 to 0.02 mol, per liter of color developer.

The coupler of formula (I) of the present invention can be incorporated into a photographic material using various known dispersion methods. One preferred example is an oil-in-water dispersion method where a coupler of formula (I) is dissolved in a high boiling point organic solvent (if desired, along with a low boiling point organic solvent), the resulting solution is dispersed in an aqueous gelatin solution by emulsification and the dispersion is added to a silver halide emulsion.

Examples of high boiling point organic solvents usable in such an oil-in-water dispersion method are described in U.S. Pat. No. 2,322,027. The details and specific examples of dispersion in a latex, as one example of a polymer dispersion method, and the effect of such a dispersion method, as well as examples of latexes usable for impregnation in the step are described in U.S. Pat. No. 4,199,363, German Patent OLS Nos. 2,541,274 and 2,541,230, JP-B-53-41091 and European Patent Laid-Open No. 029104. The details of dispersion of an organic solvent-soluble polymer are described in PCT W088/00723.

Examples of high boiling point organic solvents usable in the above-mentioned oil-in-water dispersion method are phthalates (e.g., dibutyl phthalate, dioctyl phthalate, dicyclohexyl phthalate, di-2-ethylhexyl phthalate, decyl phthalate, bis(2,4-di-tert-amylphenyl) isophthalate, bis(1,1-diethylpropyl) phthalate), phosphates and phosphonates (e.g., diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, di-2-ethylhexylphenyl phosphonate), benzoates (e.g., 2-ethylhexyl benzoate, 2,4-dichlorobenzoate, dodecyl benzoate, 2-ethylhexyl p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate, trioctyl citrate), aniline derivatives (e.g., N,N-dibutyl-2-butoxy-5-tert-octylaniline), chlorinated paraffins (e.g., paraffins having a chlorine content of from 10% to 80%), trimesates (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, 4-(4-dodecyloxyphenylsulfonyl)phenol), carboxylic acids (e.g., 2-(2,4-di-tert-amylphenoxybutyric acid, 2-ethoxyoctandedecanoic acid), and alkyl phosphates (e.g., di(2-ethylhexyl) phosphate, diphenyl phosphate). If desired, an organic solvent having a boiling point of from about 30° C. to about 160° C. can be used as an auxiliary solvent. Examples of suitable auxiliary solvents are ethyl acetate, butyl acetate, ethyl propionate, methyl ethyl ketone, cyclohexanone, 2-ethoxyethyl acetate, and dimethylformamide.

Above all, the so-called polar high boiling point organic solvents are preferably employed with the couplers of the present invention. Examples of typical high boiling point organic solvent amides useful with the couplers of the present invention, in addition to he above-mentioned ones, include those described in U.S. Pat. Nos. 2,322,027, 4,127,413 and 4,745,049 are referred to. Above all, high boiling point organic solvents having a specific inductive capacity (as measured at 25° C. and 10 Hz) of about 6.5 or more, preferably from 5 to 6.5 are preferred.

The high boiling point organic solvent is generally used in an amount of from 0 to 2.0 times by weight, preferably from 0 to 1.0 time by weight, to the coupler.

The couplers of formula (I) of the present invention can be employed in, for example, color papers, color reversal papers, direct positive color photographic materials, color negative films, color positive films, and color reversal films. In particular, use in color photographic materials having a reflective support (for example, color papers or color reversal papers) is preferred.

The silver halide emulsion which can be used in the present invention may have any halogen composition and examples include emulsions of silver iodobromide, silver iodochlorobromide, silver bromide, silver chlorobromide or silver chloride.

The preferred halogen composition varies, depending upon the kind of the photographic material in which the coupler of the invention is employed. For a color paper, a silver chlorobromide emulsion is preferred. For a picture-taking photographic material such as a color negative film or color reversal film, a silver iodobromide emulsion with a silver iodide content of from 0.5 to 30 mol % (preferably, from 2 to 25 mol %) is preferred. For a direct positive color photographic material, a silver bromide or silver chlorobromide emulsion is preferred. For a color paper photographic material for rapid processing, a so-called high silver chloride emulsion with a high silver chloride content is preferred. The silver chloride content in this type of high silver chloride emulsion is preferably 90 mol % or more, more preferably 95 mol % or more.

In such a high silver chloride emulsion, it is preferred that a silver bromide localized phase is in the inside and/or surface of the silver halide grain in the form of a layered or non-layered structure. The halogen composition in the localized phase is preferably such that the silver bromide content therein is at least 10 mol % or more, more preferably more than 20 mol %. The localized phase may be in the inside of the grain or on the edges or corners of the surface of the grain. The localized phase may be on the corners of the grain as epitaxially grown phases in a preferred embodiment.

In the present invention, a silver chlorobromide or silver chloride which does not substantially contain silver iodide is preferably used. The description ". . . does not substantially contain silver iodide" referred to herein means that the silver iodide content in the silver halide is 1 mol % or less, preferably 0.2 mol % or less.

Regarding the halogen composition of grains of constituting an emulsion for use in the present invention, the grains may have different halogen compositions. Preferably, however, the emulsion contains grains each having the same halogen composition, since the property of the grains is easily rendered uniform. Regarding the halogen composition distribution of the grains of constituting a silver halide emulsion for use in the present invention, the grain may have a so-called uniform halogen composition structure where all of the grain has the same halogen composition; or the grain may have a so-called laminate (core/shell) structure where the halogen composition of the core of the grain is different from that of the shell of the same; or the grain may have a composite halogen composition structure where the inside or surface of the grain has a non-layered different halogen composition portion (for example, when such a non-layered different halogen composition portion is on the surface of the grain, it may be on the edge, corner or plane of the grain as an integrated structure). Any halogen compositions may be appropriately selected. In order to obtain a high sensitivity photographic material, the latter laminate or composite halogen structure grains are advantageously employed, rather than uniform halogen composition structure grains. Such laminate or composite halogen composition structure grains are also preferred for preventing generation of stress marks. In the case of laminate or composite halogen composition structure grains, the boundary between the different halogen composition parts may be definite or may also be indefinite forming a mixed crystal structure because of the difference in the halogen compositions between the adjacent portions. If desired, the boundary between them may vary affirmatively.

The silver halide grains of the silver halide emulsion of the present invention may have a mean grain size of preferably from 0.1 μm to 2 μm, especially preferably from 0.15 μm to 1.5 μm. (The term "grain size" indicates the diameter of a circle having an area equivalent to the projected area of the grain, and the mean grain size indicates a number average value obtained from the measured grain sizes.) Regarding the grain size distribution of the emulsion, a so-called monodispersed emulsion having a coefficient of variation (obtained by dividing the standard deviation of the grain size distribution by the mean grain size) of 20% or less, preferably 15% or less is preferred. To obtain a broad latitude, two or more monodispersed emulsions may be blended to form a mixed emulsion for one layer, or they may be separately coated to form plural layers.

Regarding the shape of the silver halide grains of the silver halide emulsion of the present invention, the grains may be regular crystalline grains such as cubic, tetradecahedral or octahedral crystalline grains, or irregular crystalline grains such as spherical or tabular crystalline grains, or may be composite crystalline grains composed of such regular and irregular crystalline grains. They may also be tabular grains.

The silver halide emulsion for use in the present invention may be either a so-called surface latent image type emulsion forming a latent image predominately on the surface of the grain or a so-called internal latent image type emulsion forming a latent image essentially in the inside of the grain.

The silver halide photographic emulsion for use in the present invention can be produced by various known methods, for example, by the methods described in *Research Disclosure* (RD) No. 17643 (December, 1978), pages 22 to 23, "I. Emulsion Preparation and Types", ibid., No. 18716 (November, 1979), page 648; P. Glafkides, *Chemie et Phisique Photographique* (published by Paul Montel, 1967); F. Duffin, *Photographic Emulsion Chemistry* (published by Focal Press, 1966); and V. L. Zelikman et al., *Making and Coating Photographic Emulsion* (published by Focal Press, 1964).

Monodispersed emulsions prepared by the methods described in U.S. Pat. Nos. 3,574,628 and 3,655,394 and British Patent 1,413,748 are also preferably employed in the present invention.

Tabular grains having an aspect ratio of about 5 or more may also be employed in the present invention. These tabular grains may easily be prepared using known methods, for example, by the methods described in Gutoff, *Photographic Science and Engineering*, Vol. 14, pages 248 to 257 (1979); and U.S. Pat. Nos. 4,434,226, 4,414,310, 4,433,048 and 4,439,520 and British Patent 2,112,157.

Regarding the crystal structure of the silver halide grains for use in the present invention, the grains may have different halogen compositions in the inside of the grain and the surface portion thereof, or they may have a layered structure. They may be composed of different silver halide compositions bonded by epitaxial junctions. If desired, the silver halide grains may have a compound other than silver halides, such as silver rhodanide or lead oxide, bonded to the silver halide matrix by a junction.

A mixture comprising silver halide grains with different crystalline forms may also be used.

The silver halide emulsion for use in the present invention may generally be physically ripened, chemically ripened or spectrally sensitized.

Various polyvalent metal ion impurities may be introduced into the silver halide grains for use in the present invention, during the step of forming the grains or the step of physically ripening the grains. Examples of compounds usable for this purpose are salts of cadmium, zinc, lead, copper or thallium, as well as salts or complex salts of VIII Group elements such as iron, ruthenium, rhodium, palladium, osmium, iridium or platinum.

Additives usable in physical ripening, chemical ripening and spectral sensitizing steps applicable to the silver halide emulsions for use in the present invention are described in *Research Disclosure*, Nos. 17643, 18716 and 307105, and the relevant parts therein are mentioned below. Other known additives which may be used in the present invention are also described in these *Research Disclosure* references and the relevant parts therein are also mentioned below.

| Kind of Additive | RD 17643 | RD 18716 | RD 307105 |
|---|---|---|---|
| 1. Chemical Sensitizers | p. 23 | p. 648, right column | p. 866 |
| 2. Sensitivity Enhancers | | p. 648, right column | |
| 3. Spectral Sensitizers Supercolor Sensitizers | pp. 23 to 24 | p. 648, right column to p. 649, right column | pp. 866 to 868 |
| 4. Whitening Agents | p. 24 | p. 647, right column | p. 868 |
| 5. Anti-foggants Stabilizers | pp. 24 to 25 | p. 649, right column | pp. 868 to 870 |
| 6. Light-Absorbents Filter Dyes | pp. 25 to 26 | p. 649, right column to | p. 873 |

-continued

| Kind of Additive | RD 17643 | RD 18716 | RD 307105 |
|---|---|---|---|
| Ultraviolet Absorbents | | p. 650, left column | |
| 7. Stain Inhibitors | p. 25, right column | p. 650, left to right column | p. 873 |
| 8. Color Image Stabilizers | p. 25 | p. 650, left column | p. 872 |
| 9. Hardening Agents | p. 26 | p. 651, left column | pp. 874 to 875 |
| 10. Binders | p. 26 | p. 651, left column | pp. 873 to 874 |
| 11. Plasticizers Lubricants | p. 27 | p. 650, right column | p. 876 |
| 12. Coating Aids Surfactants | pp. 26 to 27 | p. 650, right column | pp. 875 to 876 |
| 13. Antistatic Agents | p. 27 | p. 650, right column | pp. 876 to 877 |
| 14. Mat Agents | | | pp. 878 to 879 |

In order to prevent a deterioration in the photographic characteristics of the photographic material of the invention due to formaldehyde gas, compounds capable of reacting with formaldehyde to solidify it, for example, those described in U.S. Pat. Nos. 4,411,987 and 4,435,503, are preferably incorporated into the material.

Various color couplers can be incorporated into the photographic material of the present invention, and examples of suitable color couplers are described in patent publications referred to in the above-mentioned RD, No. 17643, VII-C to G and RD, No. 307105, VII-C to G.

Examples of preferred yellow couplers, for example, are those described in U.S. Pat. Nos. 3,933,501, 4,022,620, 4,326,024, 4,401,752, 4,248,961, JP-B 58-10739, British Patents 1,425,020, 1,476,760, U.S. Pat. Nos. 3,973,968, 4,314,023, 4,511,649, and European Patent 249,473A.

Above all, yellow couplers capable of forming dyes, which have a maximum absorption wavelength (absorption peak) in a short-wave range and have a sharply decreasing absorption in a long-wave range can be used with the couplers of formula (I) of the present invention, to achieve the color reproducibility of the combined couplers. Such yellow couplers are described in, for example, JP-A-63-123047 and 1-173499.

Examples of preferred magenta couplers are 5-pyrazolone compounds and pyrazoloazole compounds. For instance, those described in U.S. Pat. Nos. 4,310,619, 4,351,897, European Patent 73,636, U.S. Pat. Nos. 3,061,432, 3,725,045, RD, No. 24220 (June, 1984),JP-A-60-33552, RD, No. 24230 (June, 1984), JP-A-60-43659, 61-72238, 60-35730, 55-118034, 60-185951, U.S. Pat. Nos. 4,500,630, 4,540,654, 4,556,630, and WO(PCT)88/04795 are preferred.

Typical preferred cyan couplers are phenol couplers and naphthol couplers. For instance, those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent (OLS) No. 3,329,729, European Patents 121,365A, 249,453A, U.S. Pat. Nos. 3,446,622, 4,333,999, 4,775,616, 4,451,559, 4,427,767, 4,690,889, 4,254,212, 4,296,199, and JP-A-61-42658 are preferred.

Colored couplers for correcting the unnecessary absorption of colored dyes may also be used in the present invention. Preferred examples of these colored couplers are those described in RD No. 17643, VII-G, U.S. Pat. No. 4,163,670, JP-B-57-39413, U.S. Pat. Nos. 4,004,929, 4,138,258, and British Patent 1,146,368. Additionally, couplers correcting the unnecessary absorption of the colored dyed by a phosphor dye released during coupling, as described in U.S. Pat. No. 4,774,181, as well as couplers with a dye precursor group capable of reacting with a developing agent to form a dyes, as a split-off group, as described in U.S. Pat. No. 4,777,120 are also preferably used.

Couplers capable of forming colored dyes with an appropriate diffusibility may also be used, and those described in U.S. Pat. No. 4,366,237, British Patent 2,125,570, European Patent 96,570, and West German Patent OLS No. 3,234,533 are preferred.

Polymer dye-forming couplers may also be used, and typical examples of such couplers are described in U.S. Pat. Nos. 3,451,820, 4,080,211, 4,367,282, 4,409,320, 4,576,910, and British Patent 2,102,173.

Couplers capable of releasing a photographically useful residue on coupling may also be used in the present invention. For instance, preferred DIR couplers of releasing a development inhibitor include those described in the patent publications as referred to in the above-mentioned RD, No. 17643, Item VII-F, as well as those described in JP-A-57-151944, 57-154234, 60-184248 and 63-37346, and U.S. Pat. Nos. 4,248,962 and 4,782,012 are preferred.

Preferred couplers imagewise releasing a nucleating agent or development accelerator during development are those described in British Patents 2,097,140 and 2,131,188, and JP-A-59-157638 and 59-170840.

Additionally, examples of other couplers which may be incorporated into the photographic materials of the present invention include competing couplers described in U.S. Pat. No. 4,130,427; poly-valent couplers described in U.S. Pat. Nos. 4,283,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and 62-24252; couplers releasing a dye which recolors after release from the coupler, as described in European Patent 173,302A; bleaching accelerator-releasing couplers as described in RD, Nos. 11449 and 24241, and JP-A-61-201247; ligand-releasing couplers described in U.S. Pat. No. 4,553,477; leuco dye-releasing couplers described in JP-A-63-75747; and couplers releasing a phosphor dye as described in U.S. Pat. No. 4,774,181.

The amount of couplers which may be used together with the coupler of formula (I) of the present invention is generally within the range of from 0.001 to 1 mol per mol of silver halide. Preferably, it is from 0.01 to 0.5 mol for yellow couplers; from 0.003 to 0.3 mol for magenta couplers; and from 0.002 to 0.3 mol for cyan couplers.

These additional couplers may be incorporated into the photographic material of the present invention using various known dispersion methods as described above.

The photographic material of the present invention may further contain hydroquinone derivatives, aminophenol derivatives, gallic acid derivatives and ascorbic acid derivatives, as a color fogging inhibitor.

The photographic material of the present invention may also contain various anti-fading agents. Typical organic anti-fading agents for cyan, magenta and/or yellow images usable in the present invention are hindered phenols such as hydroquinones, 6-hydroxychromans, 5-hydroxycoumarans, spirochromans, p-alkoxy-phenols and bisphenols, and gallic acid derivatives, methylenedioxybenzenes, aminophenols, hindered amines and ether or ester derivatives formed by silylating or alkylating the phenolic hydroxyl group of the compounds. In addition, metal complexes such as (bis-salicylaldoximato)nickel complexes and (bis-N,N-dialkyldithiocarbamato)nickel complexes may also be used.

Specific examples of organic anti-fading agents usable in the present invention are hydroquinones described in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromans, 5-hydroxychromans and spirochromans described in U.S. Pat. Nos. 3,432,300, 3,573,050, 3,574,627, 3,698,909 and 3,764,337, and JP-A-52-152225; spiroindanes described in U.S. Pat. No. 4,360,589; p-alkoxyphenols described in U.S. Pat. No. 2,735,765, British Patent 2,066,975, JP-A-59-10539, and JP-B-57-19765; hindered phenols described in U.S. Pat. Nos. 3,700,455 and 4,228,235, JP-A-52-72224, and JP-B-52-6623; gallic acid derivatives described in U.S. Pat. No. 3,457,079; methylenedioxybenzenes described in U.S. Pat. No. 4,332,886; aminophenols described in JP-B-56-21144; hindered amines described in U.S. Pat. Nos. 3,336,135 and 4,268,593, British Patents 1,326,889, 1,354,313 and 1,410,846, JP-B-51-1420, and JP-A-58-114036, 59-53846 and 59-78344; and metal complexes described in U.S. Pat. Nos. 4,050,938 and 4,241,155, and British Patent 2,027,731(A). The compounds are incorporated into the light-sensitive layers by co-emulsifying them with the corresponding color couplers generally in an amount of from 5 to 100% by weight to the coupler, whereby the function provided is attained. For the purpose of preventing cyan color images from fading by heat and especially by light, incorporation of an ultraviolet absorbent into the cyan coloring layer and both adjacent layers is effective.

Examples of ultraviolet absorbents usable for the purpose are aryl group-substituted benzotriazole compounds (for example, those described in U.S. Pat. No. 3,533,794), 4-thiazolidones (for example, those described in U.S. Pat. Nos. 3,314,794 and 3,352,681), benzophenone compounds (for example, those described in JP-A-46-2784), cinnamate compounds (for example, those described in U.S. Pat. Nos. 3,705,805 and 3,707,395), butadiene compounds (for example, those described in U.S. Pat. No. 4,045,229), and benzoxazole compounds (for example, those described in U.S. Pat. Nos. 3,406,070 and 4,271,307). Ultraviolet absorbing couplers (for example, α-naphthol cyan dye forming couplers) and ultraviolet absorbing polymers may also be used. These ultraviolet absorbents may be mordanted in particular layers.

Above all, aryl group-substituted benzotriazole compounds are preferred.

Gelatin is advantageously used as a binder or protective colloid in the emulsion layers of the photographic material of the present invention. Other hydrophilic colloids may also be used alone or with gelatin.

The gelatin for use in the present invention may be either a lime-processed gelatin or an acid-processed gelatin. These gelatins and their production are described in Arther Vais, *The Molecular Chemistry of Gelatin* (published by Academic Press, 1964).

The photographic material of the present invention can contain various antiseptics and fungicides, such as 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, as described in JP-A-63-257747, 62-272248 and 1-80941.

Where the photographic material of the present invention is a direct positive color photographic material, it may contain a nucleating agent, such as hydrazine compounds or quaternary heterocyclic compounds as described in *Research Disclosure* No. 22534 (January, 1983), as well as a nucleation accelerator for promoting the effect of the nucleating agent.

Examples of supports which can be used in the photographic material of the present invention are a transparent film such as cellulose nitrate film or polyethylene terephthalate film, or a reflective support, which is generally used in preparing conventional photographic materials, can be used. In view of the object of the present invention, a reflective support is more preferred.

A "reflective support" which is advantageously used in the present invention is a support capable of increasing the reflectivity of the photographic material to thereby enhance the sharpness of the color image formed in the silver halide emulsion layer. Examples of reflective supports include those prepared by coating a hydrophobic resin containing a photo-reflecting substance, such as titanium oxide, zinc oxide, calcium carbonate or calcium sulfate, dispersed therein, on a support base; and those formed from a hydrophobic resin containing the above-mentioned photo-reflective substance dispersed therein. For instance, specific examples are baryta paper; polyethylene-coated paper; polypropylene synthetic paper; and transparent supports (such as glass plates, polyester films such as polyethylene terephthalate, cellulose triacetate or cellulose nitrate film, polyamide films, polycarbonate films, polystyrene films, and vinyl chloride resin films coated with a reflective layer or containing a reflective substance.

The photographic material of the present invention may be processed in accordance with conventional photographic processing methods, for example, by the methods described in the *Research Disclosure,* No. 17643, pages 28 to 29 and ibid., No. 18716, page 615, from left to right column. For instance, the material can be subjected to a color development comprising a color developing step, a desilvering step and a rinsing step. Where the material is subjected to a reversal development, the process comprises a black-and-white developing step, a rinsing step, a reversal step and a color developing step. In the desilvering step, bleaching with a bleaching solution and fixing with a fixing solution are accomplished. A combined bleach-fixing with a bleach-fixing solution may also be used. The bleaching step, the fixing step and the bleach-fixing step may be conducted in any desired order. A stabilization may be used in place of rinsing. If desired, the photographic material may be processed with a mono-bath process using a mono-bath developing and bleach-fixing solution where color development, bleaching and fixation are effected in one bath. Anyone of a pre-hardening step, a neutralization step, a stopping and fixing step, a post-hardening step, an adjusting step and an intensifying step may be carried out as a combination of processing steps. Between these steps, any desired inter-rinsing step may be carried out. In place of the color development step, a so-called activator processing step may also be conducted.

The color developer to be used for developing the photographic material of the present invention is an aqueous alkaline solution containing an aromatic primary amine color developing agent as a main component. Examples of useful color developing agents are aminophenol compounds but p-phenylenediamine compounds are more preferably used. Specific examples of these compounds are 3-methyl-4-amino-N,N-diethylaniline, 3-methyl-4-amino-N-ethyl-N-β-hydroxyethylaniline, 4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and sulfates, hydrochlorides and p-toluenesulfonates of these compounds. These compounds may be used alone or as a combination of two or more thereof depending on the object desired.

The color developer generally contains a pH buffer such as alkali metal carbonates, borates or phosphates; and a development inhibitor or an antifoggant such as chlorides, bromides, iodides, benzimidazoles, benzothiazoles or mercapto compounds. If desired, it may also contain various preservatives, such as hydroxylamine, diethylhydroxylamine, sulfites, hydrazines (e.g., N,N-biscarboxymethylhydrazine), phenylsemicarbazides, triethanolamine, and catecholsulfonic acids; organic solvents such as ethylene glycol or diethylene glycol; development accelerators such as benzyl alcohol, polyethylene glycol, quaternary ammonium salts or amines; dye forming couplers; competing couplers; auxiliary developing agents such as 1-phenyl-3-pyrazolidone; nucleating agents such as sodium borohydride or hydrazine compounds; tackifiers; various chelating agents such as aminopolycarboxylic acids, aminopolyphosphonic acids, alkylphosphonic acids or phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts thereof); brightening agents such as 4,4'-diamino-2,2'-disulfostilbene compounds; and various surfactants such as alkylsulfonic acids, arylsulfonic acids, aliphatic carboxylic acids and aromatic carboxylic acids.

The color developer for use in the present invention preferably does not contain substantially any benzyl alcohol. The color developer not containing substantially any benzyl alcohol is a developer containing benzyl alcohol preferably in an amount of 2 ml/liter or less, more preferably 0.5 ml/liter or less, most preferably one containing no benzyl alcohol.

The color developer for use in the present invention also preferably does not contain substantially any sulfite ion. The color developer not containing substantially any sulfite ion is one containing sulfite ion preferably in an amount of $3.0\times10^{-3}$ mol/liter or less, more preferably one containing no sulfite ion.

The color developer for use in the present invention further does not contain substantially any hydroxylamine. The color developer not containing substantially any hydroxylamine is one containing hydroxylamine preferably in an amount of $5.0\times10^{-3}$ mol/liter or less, more preferably one containing no hydroxylamine. The color developer for use in the present invention advantageously contains an organic preservative (for example, hydroxylamine derivatives or hydrazine derivatives), other than hydroxylamine.

The color developer generally has a pH of from 9 to 12.

The color reversal process which can be applied to the photographic material of the present invention generally comprises a black-and-white processing step, a rinsing step, a reversal processing step and a color development step. The reversal processing step may use a reversal bath containing a foggant or may be effected using a photo-reversal treatment. If desired, such a foggant may be incorporated into a color developer and the reversal processing step can be omitted.

The black-and-white developer to be used in the black-and-white processing step may be any conventional developer usable for processing conventional black-and-white photographic materials, and it may contain additives generally applicable to conventional black-and-white developers.

Typical additives include developing agents such as 1-phenyl-3-pyrazolidone, N-methyl-p-aminophenol and hydroquinone; preservatives such as sulfites; pH buffers of water-soluble acids such as acetic acid or boric acid; pH buffers or development accelerators comprising water-soluble alkalis such as sodium hydroxide, sodium carbonate or potassium carbonate; inorganic or organic development inhibitors such as potassium bromide, 2-methylbenzimidazole or methylbenzothiazole; water softeners such as ethylenediaminetetraacetic acid or polyphosphates; antioxidants such as ascorbic acid or diethanolamine; organic solvents such as triethylene glycol or cellosolves; and surface overdevelopment inhibitors such as a slight amount of iodides or mercapto compounds.

Where the amount of replenisher to such a developer is reduced, it is desired for evaporation or aerial oxidation of the processing solution to be prevented by reducing the contact area between the surface of the processing tank and air. Methods of reducing the contact area between the surface of the processing tank and air include a surface-masking substance such as a floating lid on the surface of the processing solution in the processing tank. It is preferred for this technique to be employed not only in both of the color development and black-and-white development steps but also in all of the successive steps. In addition, a recovery means to prevent accumulation of bromide ions in the developer tank may also be employed to reduce the amount of replenisher to be added to the tank.

The color development time is generally between 2 minutes and 5 minutes. However, by elevating the processing temperature and elevating the pH of the processing solution (developer) and further elevating the concentration of the color developing agent in the developer, the processing time (color development time) may be shortened further.

The photographic emulsion layer is, after color-development, desilvered. Desilvering is effected by simultaneous or separate bleaching and fixation. Bleach-fixation comprising simultaneous bleaching and fixation can be used. In order to further accelerate the processing, bleach-fixation may be effected after bleaching. If desired, a bleaching bath comprising two tanks connected in series may be used; or fixation may be effected before bleach-fixation; or bleach-fixation may be effected after bleaching. The processing systems may be selected and employed depending on the object desired. In processing the photographic material of the present invention, it is advantageous for the material to be color-developed and then immediately bleach-fixed to more efficiently achieve the effect of the present invention.

Bleaching agents which can be used in the bleaching solution or bleach-fixing solution usable in the present invention are compounds of polyvalent metals such as iron(III); per acids; quinones; and iron salts. Specific examples of these agents are iron chloride; ferricyanides; bichromates; organic complexes of iron(III) (for example, metal complexes of aminopolycarboxylic acids such as ethylenediaminetetraacetic acid, diethylenetriaminepentaacetic acid, 1,3-diaminopropanetetraacetic acid); and persulfates. Above all, aminopolycarboxylato/iron(III) complexes are preferred to efficiently achieve the effect of the present invention. Aminopolycarboxylato/iron(III) complexes are useful both in a bleaching solution and especially in a bleach-fixing solution. The bleaching solution or bleach-fixing solution containing such an aminopolycarboxylato/iron(III) complex is used under the condition of a pH of from 3.5 to 8.

The bleaching solution or bleach-fixing solution may contain various known additives, for example, a rehalogenating agent such as ammonium bromide or ammonium chloride; a pH buffer such as ammonium nitrate; and a metal corrosion inhibitor such as ammonium sulfate.

The bleaching solution or bleach-fixing solution preferably contains an organic acid for the purpose of preventing bleaching stains, in addition to the above-described compounds. Especially preferred organic acids for this purpose are compounds having an acid dissociation constant (pKa) of from 2 to 5.5. Acetic acid and propionic acid are preferred.

Examples of fixing agents to be in the fixing solution or bleach-fixing solution to be used in the present invention are thiosulfates, thiocyanates, thioether compounds, thioureas, and a large amount of iodides. Thiosulfates are generally used. In particular, ammonium thiosulfate is most widely used. In addition, a combination of thiosulfates and thiocyanates, thioether compounds or thioureas can also be advantageously used.

The fixing solution of the bleach-fixing solution may contain a preservative such as sulfites, bisulfites, carbonyl-bisulfite adducts, or sulfinic acid compounds described in European Patent 294,769A. In addition, it is preferred to add various aminopolycarboxylic acids or organic phosphonic acids (e.g., 1-hydroxyethylidene-1,1-diphosphonic acid, N,N,N',N'-ethylenediaminetetraphosphonic acid) to the fixing solution or bleach-fixing solution for the purpose of stabilizing the solution.

The fixing solution or bleach-fixing solution may further contain various brightening agents, defoaming agents, surfactants, polyvinyl pyrrolidone and methanol.

The bleaching solution and bleach-fixing solution and the pre-bath thereof may optionally contain a bleaching accelerator. Specific examples of usable bleaching accelerators are compounds having a mercapto group or disulfido group as described in U.S. Pat. No. 3,893,858, German Patents 1,290,812 and 2,059,988, JP-A-53-32736, 53-57831, 53-37418, 53-72623, 53-95630, 53-95631, 53-104232, 53-124424, 53-141623 and 53-28426, and *Research Disclosure*, No. 17129 (July, 1978); thiazolidine derivatives described in JP-A-50-140129; thiourea derivatives described in JP-B-45-8506, JP-A-52-20832 and 53-32735, and U.S. Pat. No. 3,706,561; iodides described in German Patent 1,127,715, and JP-A-58-16235; polyoxyethylene compounds described in German Patents 966,410 and 2,748,430; polyamine compounds described in JP-B-45-8836; compounds described in JP-A-49-42434, 49-59644, 53-94927, 54-35727, 55-26506 and 58-163940; and bromide ions. Above all, compounds having a mercapto group or disulfido group are preferred because of a large accelerating effect, and in particular, those described in U.S. Pat. No. 3,893,858, German Patent 1,290,812 and JP-A-53-95630 are especially preferred. In addition, the compounds described in U.S. Pat. No. 4,552,834 are also preferred. Such a bleaching accelerator may be added to the photographic material. Where the photographic material of the present invention is a picture-taking color photographic material and it is bleach-fixed, the above-described bleaching accelerators are especially effective.

The total desilvering time preferably should be as short as possible within the range that desilvering is achieved. The preferred time is from one minute to 3 minutes. The processing temperature may be between 25° C. and 50° C., preferably between 35° C. and 45° C.

In the desilvering step, it is desired to enhance the degree of stirring as much as possible. Specific means for accelerating the stirring are a method of jetting a stream of the processing solution against the emulsion-coated surface of the photographic material being processed, as described in JP-A-62-183460. This stirring acceleration means is effective also in processing steps involving a bleaching solution, a bleach-fixing solution and a fixing solution.

The photographic material of the present invention is generally rinsed, after being desilvered as mentioned above. Stabilization may also be conducted in place of rinsing. In the stabilization step, any known methods as described, for example, in JP-A-57-8543, 58-14834 and 60-220345 may be employed. If desired, a combined rinsing-stabilization step may be effected, in which a stabilizing bath containing a dye-stabilizing agent and a surfactant is used as the final bath. The step is conveniently applied to picture-taking color photographic materials.

The rinsing solution and stabilizing solution applicable to the photographic material of the present invention may contain a water softener such as inorganic phosphoric acids, polyaminocarboxylic acids or organic aminophosphonic acids; a microbiocide such as isothiazolone compounds or thiabendazoles, or a chlorine-containing microbiocide such as sodium chloroisocyanurate; a metal salt such as magnesium salts, aluminum salts or bismuth salts; a surfactant; a hardening agent; and a bactericide.

The amount of the rinsing water to be used in the rinsing step may be set in a broad range, depending upon the properties of the photographic material being processed (for example, the components of the material, such as couplers, etc.), the use of the material, the temperature of the rinsing water, the number of rinsing tanks (the number of rinsing stages), the replenishment system (either countercurrent type or normal current type), and other various conditions. The relationship between the number of rinsing tanks and the rinsing water in a multi-stage countercurrent rinsing system may be obtained in accordance with the method described in *Journal of the Society of Motion Picture and Television Engineers*, Vol. 64, pages 248 to 253 (May, 1955). The method of reducing the amounts of calcium ions and magnesium ions in the rinsing water, as described in JP-A-62-288838, may be used extremely effectively.

The rinsing water has a pH of from 4 to 9, preferably from 5 to 8. The temperature of the rinsing water and the rinsing time may also be varied, depending upon the properties and the uses of the photographic material being processed. In general, the rinsing temperature is from 15° C. to 45° C. and the rinsing time is from 20 seconds to 10 minutes; preferably, the former is from 25° C. to 40° C. and the latter is from 30 seconds to 5 minutes.

Examples of dye stabilizing agents which may be used in the stabilizing solution are aldehydes such as formaldehyde and glutaraldehyde; N-methylol compounds such as dimethylolurea; hexamethylenetetramine; and aldehyde-sulfite adducts. The stabilizer may further contain a pH adjusting buffer such as boric acid or sodium hydroxide; a chelating agent such as 1-hydroxyethylidene-1,1-diphosphonic acid or ethylenediaminetetraacetic acid; an antioxidant such as alkanolamines; a brightening agent; and a fungicide.

The overflow liquid due to replenishment of the above-mentioned rinsing solution and/or the stabilizing solution may be re-circulated to the other bath such as a previous desilvering bath.

The photographic material of the present invention can contain a color developing agent for the purpose of simply and rapidly processing the material. Preferably, various precursors of color developing materials are incorporated into the material. For instance, examples of usable precursors are indoaniline compounds described in U.S. Pat. No. 3,342,597, Schiff base compounds described in U.S. Pat. No. 3,342,599, *Research Disclosure* No. 14850 and ibid., No. 15159, aldol compounds described in *Resarch Disclosure*, No. 13924, metal complexes described in U.S. Pat. No. 3,719,492, and urethane compounds described in JP-A-53-135628.

The photographic material of the present invention may contain, if desired, various 1-phenyl-3-pyrazolidones for the purpose of promoting the color developability thereof. Specific examples of compounds usable for the purpose are described in JP-A-56-64339, 57-144547 and 58-115438.

In processing the photographic material of the present invention, the processing solutions are used at a temperature between 10° C. and 50° C. In general, the standard processing temperature is between 33° C. and 38° C. The processing temperature may be increased to promote the processing step or to shorten the processing time or it may be decreased to improve the image quality of the image to be formed or to promote the stability of the processing solutions being used.

The present invention is explained in greater detail by way of the following examples, which, however, are not to be construed as limiting the scope of the present invention.

EXAMPLE 1

For the purpose of identifying the basic color hue of cyan dyes produced by the couplers of formula (I) of the present invention, Dye (60) was produced from Compound (15) and the absorption wavelength and molecular extinction coefficient thereof were measured.

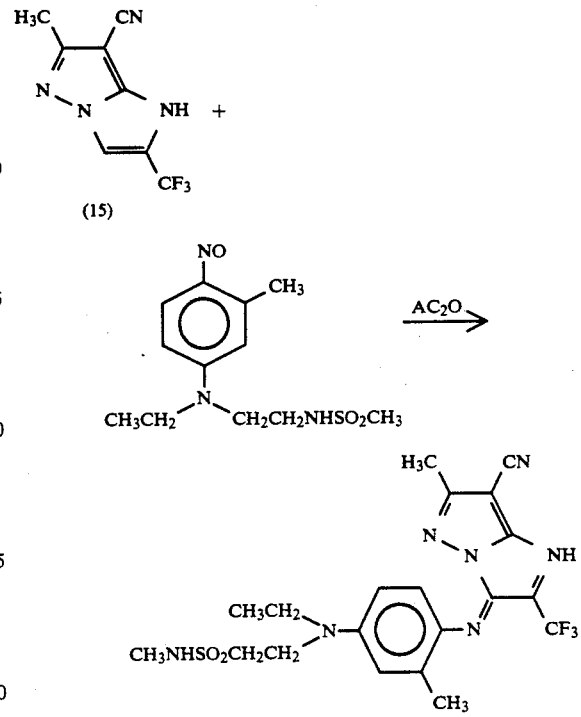

Compound (61) from a known phenol compound was used as a comparative cyan dye.

Table 1 below shows the values of the maximum absorption wavelength and molecular extinction coefficient in acetonitrile of each of Dyes (60) and (61); and FIG. 1 attached hereto shows the absorption wave form in ethyl acetate of each of them. FIG. 2 shows the absorption wave form in ethyl acetate in Dye (62) as obtained from a coupler described in U.S. Pat. No. 4,728,598 as a comparative example.

TABLE 1

| Dye | Maximum Absorption Wavelength (nm) | Molecular Extinction Coefficient ($l \cdot mol^{-1} \cdot cm^{-1}$) |
|---|---|---|
| (60) | 623.6 | 69,800 |
| (61) | 654.8 | 24,100 |

TABLE 1-continued (61)

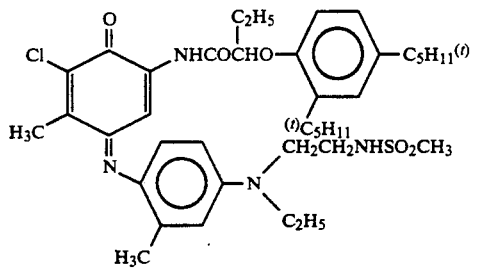

(62)

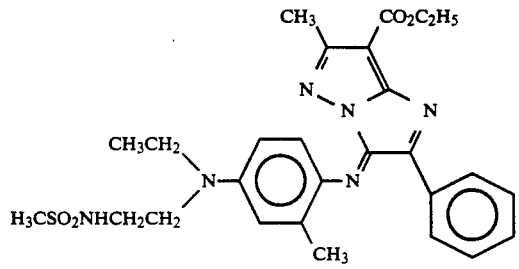

As is noted from the data in Table 1 above, the coupler of the present invention produced Dye (60) has a larger molecular extinction coefficient than Dye (61) obtained from a known phenol coupler.

Figure 2:
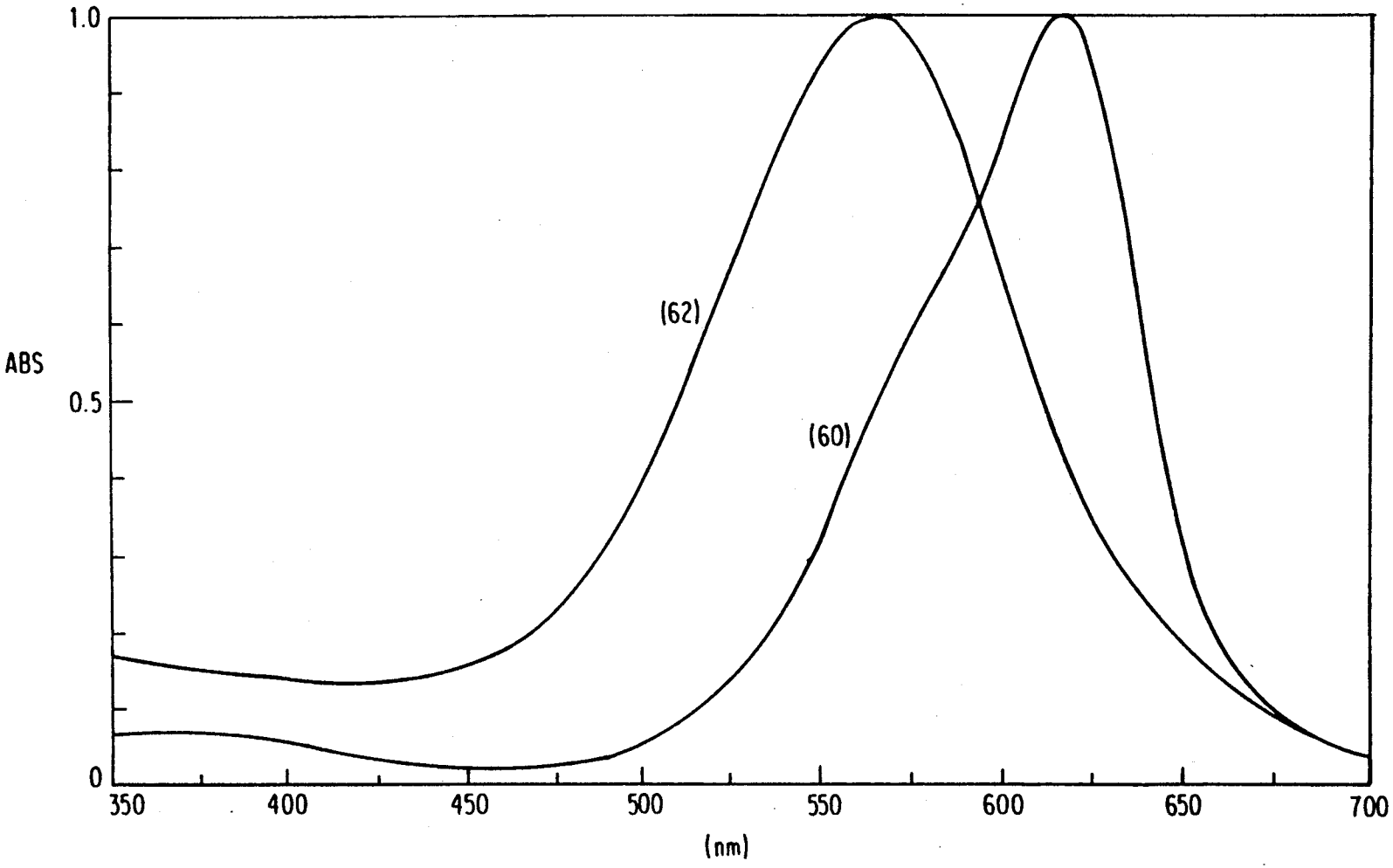
FIG. 2 shows absorption wave forms (in ethyl acetate) of a cyan dye (60) and a dye (62) as formed from a coupler described in U.S. Pat. No. 4,728,598.

As is also noted from FIG. 1, Dye (60) of the present invention had higher toe sharpness and less side absorption on the short-wave side than the comparative Dye (61). From these results, it is obvious that Dye (60) is an extremely excellent cyan dye. From FIG. 2, it is noted that Dye (62) obtained from the coupler described in U.S. Pat. No. 4,728,598 is a magenta dye, which had a large side absorption and a broad maximum absorption.

EXAMPLE 2

For the purpose of testing the light fastness of cyan dyes obtained from couplers of formula (I) of the present invention, Dye (60) obtained from Compound (15) was exposed to a full xenon light in acetonitrile, whereupon the light stability thereof was measured with a spectrophotometer (UV-260 Model, manufactured by Hitachi). A a comparative compound, Dye (61) was tested in the same manner.

Table 2 below shows data of time-dependent color retentivity (%) of each dye under full light exposure.

TABLE 2

| Time (hr) | Dye (60) (%) | Dye (61) (%) |
|---|---|---|
| 0.5 | 94.2 | 89.8 |
| 1.0 | 92.3 | 78.3 |
| 2.0 | 89.4 | 57.9 |
| 3.0 | 78.2 | 36.1 |
| 4.0 | 69.7 | 17.7 |

As is obvious from the data in Table 2 above, Dye (60) was much faster to light than Dye (61).

EXAMPLE 3

Preparation of Sample No. 101

Two layers as described below were formed on a cellulose triacetate film support to prepare a photographic material sample (Sample No. 101). The coating composition for the first layer was prepared as described below.

Preparation of Coating Composition for First Layer 1.01 g of cyan coupler (A-1) and 1.0 g of dibutyl phthalate were completely dissolved in 10.0 cc of ethyl acetate. The ethyl acetate solution of coupler was added to 42 g of an aqueous 10% gelatin solution (containing 5 g/liter of sodium dodecylbenzenesulfonate) and dispersed by emulsification using a homogenizer. After dispersion and emulsification, a distilled water was added to the resulting dispersion to make the total amount of 100 g. 100 G of the dispersion and 8.2 g of a high silver chloride emulsion (having a silver bromide content of 0.5 mol %) were blended to prepare a coating composition for the first layer, which contained the components described below. 1-Hydroxy-3,5-dichloro-s-triazine sodium salt was used as a gelatin hardening agent.

Layer Constitution

The layers contained the components described below.

Support

Cellulose Triacetate Film

| | |
|---|---|
| First Layer (Emulsion Layer): | |
| High Silver Chloride Emulsion | 0.32 g/m$^2$ as Ag |
| Gelatin | 2.50 g/m$^2$ |
| Cyan Coupler (A-1) | 0.49 g/m$^2$ |
| Dibutyl Phthalate | 0.49 g/m$^2$ |
| Second Layer (Protective Layer): | |
| Gelatin | 1.60 g/m$^2$ |

Preparation of Samples Nos. 102 to 110

Samples Nos. 102 to 110 were prepared in the same manner as above, except that the cyan coupler (A-1) in Sample No. 101 was replaced by the same molar amount of the coupler as shown in Table 1 below.

Cyan Coupler (A-1):

-continued

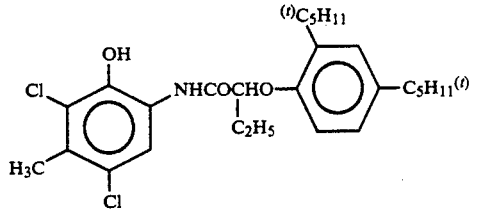

Samples Nos. 101 to 110 thus prepared were wedgewise exposed using a white light and then processed in accordance with the process described below.

The processed samples were evaluated with respect to the color hue and the heat-fastness of the image formed.

The color absorption of the maximum density part of the processed sample was measured. The side absorption and the sharpness of the toe in the shortwave side were obtained in accordance with the following formulae. From the values obtained, the color hue of the processed sample was evaluated.

Side Absorption = (Absorption density at 420 nm)/(Absorption Density at Maximum Absorption Wavelength)

Sharpness of Toe in Short-wave Side = (Absorption Density at 550 nm)/(Absorption Density at Maximum Absorption Wavelength)

The results obtained are shown in Table 3 below.

| Processing Step | Temperature | Time |
|---|---|---|
| Color Development | 38° C. | 45 sec |
| Bleach-Fixation | 35° C. | 45 sec |
| Rinsing (1) | 35° C. | 30 sec |
| Rinsing (2) | 35° C. | 30 sec |
| Rinsing (3) | 35° C. | 30 sec |
| Drying | 80° C. | 60 sec |

(Rinsing was effected using a 3-tank counter flow system from (3) to (1).)

The processing solutions used had the following compositions.

| | |
|---|---|
| Color Developer: | |
| Water | 800 ml |
| Ethylenediamine-N,N,N,N-tetramethylenephosphonic Acid | 3.0 g |
| Triethanolamine | 8.0 g |
| Potassium Chloride | 3.1 g |
| Potassium Bromide | 0.015 g |
| Potassium Carbonate | 25 g |
| Hydrazinodiacetic Acid | 5.0 g |
| N-Ethyl-N-(β-methanesulfonamidoethyl)-3-methyl-4-aminoaniline Sulfate | 5.0 g |
| Brightening Agent (WHITEX-4, product by Sumitomo) | 2.0 g |
| Water to make | 1000 ml |
| pH (with potassium hydroxide) | 10.05 |
| Bleach Fixing Solution: | |
| Water | 400 ml |
| Ammonium Thiosulfate Solution (700 g/liter) | 100 ml |
| Ammonium Sulfite | 45 g |
| Ammonium Ethylenediaminetetraacetato/Iron(III) | 55 g |
| Ethylenediaminetetraacetic Acid | 3 g |
| Ammonium Bromide | 30 g |
| Nitric Acid (67% aq. soln.) | 27 g |
| Water to make | 1000 ml |
| pH | 5.8 |

Rinsing Solution

Ion-exchanged Water (having calcium and magnesium contents of each 3 ppm or less).

TABLE 3

| Sample No. | Coupler | Side Absorption | Sharpness of Toe on Short-wave Side | Remarks |
|---|---|---|---|---|
| 101 | A-1 | 0.177 | 0.102 | Comparative Sample |
| 102 | Coupler (1) | 0.068 | 0.105 | Sample of Invention |
| 103 | Coupler (5) | 0.070 | 0.102 | Sample of Invention |
| 104 | Coupler (7) | 0.065 | 0.106 | Sample of Invention |
| 105 | Coupler (10) | 0.073 | 0.100 | Sample of Invention |
| 106 | Coupler (13) | 0.068 | 0.103 | Sample of Invention |
| 107 | Coupler (17) | 0.075 | 0.098 | Sample of Invention |
| 108 | Coupler (20) | 0.080 | 0.092 | Sample of Invention |
| 109 | Coupler (21) | 0.070 | 0.105 | Sample of Invention |
| 110 | Coupler (23) | 0.077 | 0.109 | Sample of Invention |

It is obvious from the results in Table 3 above that the couplers of the present invention (Samples Nos. 102 to 110) provided dyes having a small side absorption and having a sharp toe in the short-wave side.

EXAMPLE 4

Samples Nos. 201 to 210 were prepared in the same manner as in Example 3, except that a silver iodobromide emulsion (having a silver iodide content of 8.0 mol %) was used in place of the high silver chloride emulsion in Samples Nos. 101 to 110, respectively.

Evaluation of Coloring Property

The thus prepared Samples Nos. 201 to 210 were subjected to continuous wedgewise exposure to white light and then developed in accordance with the processing procedure described below.

After development, the density of each of the developed samples was measured and the characteristic curve (cyan density to log E) of each sample was obtained. On the characteristic curve, the coloring property of each sample was obtained from the logarithmic value (log E versus sensitivity) of the exposure amount of giving a density of (fog density+0.2). On the basis of the sensitivity (standard value) of Sample No. 201, the relative sensitivity value of each of the other samples was calculated. The results obtained are shown in Table 4 below.

Next, on the same characteristic curve, the value of the slope of the line obtained by linking a point giving a density value of (fog density+0.2) and a point giving a density value of (fog density+0.7) was obtained, which indicates the gradation of each sample. On the basis of the value (standard) of Sample No. 201, the relative value of each of the other samples was calculated. The results obtained are also shown in Table 4.

| Photographic Processing Method | | |
|---|---|---|
| Processing Step | Time | Temperature |
| Color Development | 3 min 15 sec | 38° C. |
| Bleaching | 1 min 00 sec | 38° C. |
| Bleach-Fixation | 3 min 15 sec | 38° C. |
| Rinsing (1) | 0 min 40 sec | 35° C. |
| Rinsing (2) | 1 min 00 sec | 35° C. |
| Stabilization | 0 min 40 sec | 38° C. |
| Drying | 1 min 15 sec | 55° C. |

The processing solutions used above had the following compositions.

| | |
|---|---|
| Color Developer: | |
| Diethylenetriaminepentaacetic Acid | 1.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-[N-ethyl-N-β-hydroxyethyl-amino]-2-methylaniline Sulfate | 4.5 g |
| Water to make | 1.0 liter |
| pH | 10.05 |
| Bleaching Solution: | |
| Ammonium Ethylenediaminetetra-acetato/Iron(III) (dihydrate) | 120.0 g |
| Disodium Ethylenediaminetetraacetate | 10.0 g |
| Ammonium Bromide | 100.0 g |
| Ammonium Nitrate | 10.0 g |
| Bleaching Accelerator | 0.005 mol |

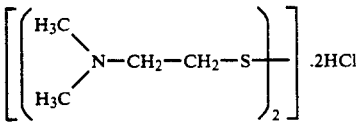

| | |
|---|---|
| Aqueous Ammonia (27% aq. soln.) | 15.0 ml |
| Water to make | 1.0 liter |
| pH | 6.3 |
| Bleach-Fixing Solution: | |
| Ammonium Ethylenediaminetetra-acetato/Iron(III) (dihydrate) | 50.0 g |
| Disodium Ethylenediaminetetraacetate | 5.0 g |
| Sodium Sulfite | 12.0 g |
| Ammonium Thiosulfate (70% aq. soln.) | 240.0 ml |
| Aqueous Ammonia (27% aq. soln.) | 6.0 ml |
| Water to make | 1.0 liter |
| pH | 7.2 |

Rinsing Solution

City water was passed through a mixed bed type column filled with an H-type strong acidic cation-exchange resin (Amberlite IR-120B, produced by Rhom & Haas Co.) and an OH type strong basic anion-exchange resin (Amberlite IRA-400, produced by Rhom & Haas Co.) so that both the calcium ion concentration and the magnesium ion concentration in the water were reduced to 3 mg/liter, respectively. Next, 20 ml/liter of sodium dichloroisocyanurate and 150 mg/liter of sodium sulfate were added to the resulting water, which had a pH within the range of from 6.5 to 7.5. This was used as the rinsing water.

| | |
|---|---|
| Stabilizing Solution: | |
| Formaldehyde | 2.0 ml |

-continued

| | |
|---|---|
| Polyoxyethylene-p-monononylphenyl Ether (mean polymerization degree 10) | 0.3 g |
| Disodium Ethylenediaminetetraacetate | 0.05 g |
| Water to make | 1.0 liter |
| pH | 5.0 to 8.0 |

TABLE 4

| Sample No. | Coupler | Relative Sensitivity | Gradation (Relative Value) | Remarks |
|---|---|---|---|---|
| 201 | A-1 | 100 | 1.00 | Comparative Sample |
| 202 | Coupler (1) | 112 | 1.07 | Sample of Invention |
| 203 | Coupler (5) | 110 | 1.06 | Sample of Invention |
| 204 | Coupler (7) | 113 | 1.07 | Sample of Invention |
| 205 | Coupler (10) | 108 | 1.05 | Sample of Invention |
| 206 | Coupler (13) | 115 | 1.08 | Sample of Invention |
| 207 | Coupler (17) | 109 | 1.06 | Sample of Invention |
| 208 | Coupler (20) | 111 | 1.06 | Sample of Invention |
| 209 | Coupler (21) | 108 | 1.05 | Sample of Invention |
| 210 | Coupler (23) | 106 | 1.04 | Sample of Invention |

As is obvious from the data in Table 4 above, the couplers of the present invention had higher sensitivity and gradation and therefore had a higher coloring property than the comparative coupler in Sample No. 201.

EXAMPLE 5

Samples Nos. 201 to 210 as prepared in Example 4 were wedgewise exposed to white light and then processed in accordance with the processing procedure described below.

The processed samples were subjected to fading testing by storing them at 80° C. for 2 weeks, whereupon the cyan density ($D_R$) at the part With a cyan density of 1.0 before the test was measured. Color retention degree obtained using the following formula, and the image fastness of each sample was determined on the basis of the color retention value obtained. The results obtained are shown in Table 5 below.

$$\textit{Color Retention Percentage} = \{(D_R)/1.0\} \times 100$$

Another group of Samples Nos. 201 to 210 prepared in the same way as above was exposed to a xenon light using a xenon fade tester for 5 days, and the light fastness of the exposed samples was evaluated in the same manner as above. The results obtained are also shown in Table 5.

From the characteristic curve of each of the processed samples, it was confirmed that the couplers of the present invention had higher sensitivity and gradation and therefore had a higher coloring property than the comparative coupler in Sample No. 201, just as in Example 3.

| Photographic Processing Method | | |
|---|---|---|
| Step | Time | Temperature |
| First Development | 6 min | 38° C. |
| Rinsing | 2 min | 38° C. |

-continued

| Photographic Processing Method | | |
|---|---|---|
| Step | Time | Temperature |
| Reversal | 2 min | 38° C. |
| Color Development | 6 min | 38° C. |
| Adjustment | 2 min | 38° C. |
| Bleaching | 6 min | 38° C. |
| Fixation | 4 min | 38° C. |
| Rinsing | 4 min | 38° C. |
| Stabilization | 1 min | room temperature |
| Drying | | |

The processing solutions used above had the following compositions.

| | |
|---|---|
| First Developer: | |
| Water | 700 ml |
| Pentasodium Nitrilo-N,N,N-trimethylenephosphonate | 2 g |
| Sodium Sulfite | 20 g |
| Hydroquinone monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% aq. soln.) | 2 ml |
| Water to make | 1000 ml |
| Reversal Processing Solution: | |
| Water | 700 ml |
| Pentasodium Nitrilo-N,N,N-trimethylenephosphonate | 3 g |
| Stannous Chloride (dihydrate) | 1 g |
| P-aminophenol | 0.1 g |
| Sodium Hydroxide | 8 g |
| Glacial Acetic Acid | 15 ml |
| Water to make | 1000 ml |
| Color Developer: | |
| Water | 700 ml |
| Pentasodium Nitrilo-N,N,N-trimethylenephosphonate | 3 g |
| Sodium Sulfite | 7 g |
| Sodium Tertiary Phosphate 12-Hydrate | 36 g |
| Potassium Bromide | 1 g |
| Potassium Iodide (0.1% aq. soln.) | 90 ml |
| Sodium Hydroxide | 3 g |
| Citrazinic Acid | 1.5 g |
| N-ethyl-N-(β-methanesulfonamido-ethyl)-3-methyl-4-aminoaniline Sulfate | 11 g |
| 3,6-Dithiooctane-1,8 diol | 1 g |
| Water to make | 1000 ml |
| Adjusting Solution: | |
| Water | 700 ml |
| Sodium Sulfite | 12 g |
| Sodium Ethylenediaminetetraacetate (dihydrate) | 8 g |
| Thioglycerine | 0.4 ml |
| Glacial Acetic Acid | 3 ml |
| Water to make | 1000 ml |
| Bleaching Solution: | |
| Water | 800 ml |
| Sodium Ethylenediaminetetraacetate (dihydrate) | 2 g |
| Ammonium Ethylenediaminetetra-acetato Iron(III) (dihydrate) | 120 g |
| Potassium Bromide | 100 g |
| Water to make | 1000 ml |
| Fixing Solution: | |
| Water | 800 ml |
| Sodium Thiosulfate | 80.0 g |
| Sodium Sulfite | 5.0 g |
| Sodium Bisulfite | 5.0 g |
| Water to make | 1000 ml |
| Stabilizing Solution: | |
| Water | 800 ml |
| Formaldehyde (37 wt. %) | 5.0 ml |
| Fuji Drywell (surfactant, product by Fuji Photo Film Co.) | 5.0 ml |
| Water to make | 1000 ml |

TABLE 5

| Sample No. | Coupler | Color Image Fastness Heat | Light | Remarks |
|---|---|---|---|---|
| 201 | A-1 | 74 | 83 | Comparative Sample |
| 202 | Coupler (1) | 92 | 98 | Sample of Invention |
| 203 | Coupler (5) | 92 | 98 | Sample of Invention |
| 204 | Coupler (7) | 92 | 98 | Sample of Invention |
| 205 | Coupler (10) | 91 | 97 | Sample of Invention |
| 206 | Coupler (13) | 92 | 98 | Sample of Invention |
| 207 | Coupler (17) | 91 | 97 | Sample of Invention |
| 208 | Coupler (20) | 90 | 96 | Sample of Invention |
| 209 | Coupler (21) | 90 | 96 | Sample of Invention |
| 210 | Coupler (23) | 90 | 96 | Sample of Invention |

As is obvious from the results in Table 5 above, the dyes formed from the couplers of the present invention had greater fastness to light under at high temperature than the dye formed from the comparative coupler (A-1) in Sample No. 201.

EXAMPLE 6

A silver halide color photographic sample corresponding to Sample No. 214 (multi-layered color paper) of Example 2 of European Patent EP 0,355,660A2 (corresponding to JP-A-2-139544, U.S. Ser. No. 07/393,747) was prepared but, bisphenol compound (III-10) was used in place of (III-23), yellow coupler (ExY), image stabilizer (Cpd-8), solvent (Solv-6) and oxonole dyes were replaced by the following compounds, the following microbicide compound was incorporated, and cyan couplers in the fifth layer were replaced by the same molar amounts of Couplers (1), (3), (4), (9), (10), (12), (14), (17), (19), (22) or (24).

-continued
(ExY) Yellow Coupler:
1/1 (by mol) mixture of the following compounds:
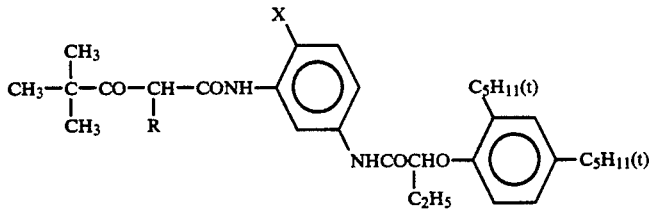
R =
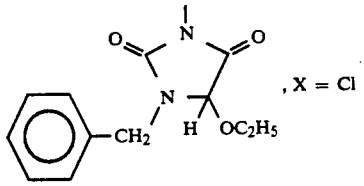
, X = Cl
and
R =
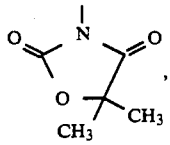
, X = $OCH_3$
(Cpd-8) Color Image Stabilizer:
1/1 (by mol) mixture of the following compounds:
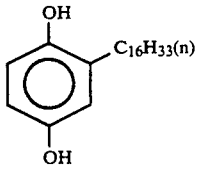
and
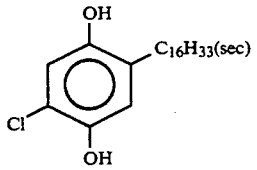
(Cpd-10) Microbicide:
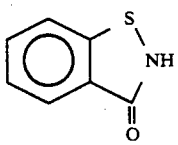
(25.0 mg/$m^2$)
(Cpd-11) Microbicide:
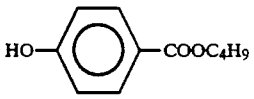
(50.0) mg/$m^2$)
(Solv-6) Solvent:
9/1 (by weight) mixture of the following compounds:
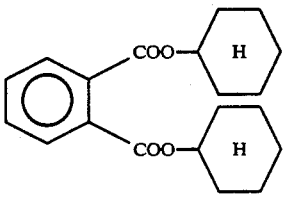
and -continued

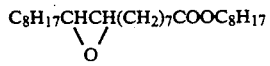

Oxonole Dyes:

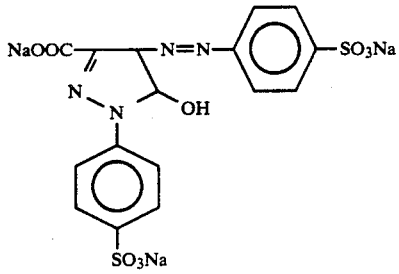

(10 mg/m²)

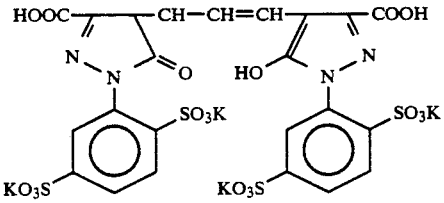

(10 mg/m²)

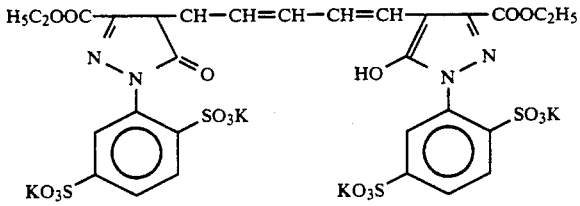

(40 mg/m²)

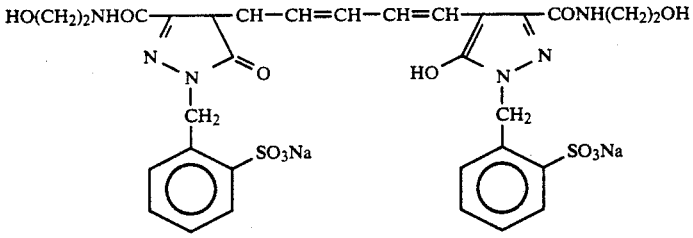

(20 mg/m²)

The color photographic material samples thus prepared were processed in accordance with the process of Example 2.

As a result, all the samples showed an excellent color reproducibility (especially, reproduction of green color) and the images formed had an excellent color fastness.

As will be understood from the above-mentioned explanation, the new cyan couplers of formula (I) of the present invention react with the oxidation product of aromatic primary amine color developing agents to produce excellent cyan dyes and cyan images having satisfactory absorption characteristic and color fastness. In particular, the dyes produced from couplers of formula (I) show little side absorption in a short wavelength range, and the couplers display an excellent coloring property. They may be used for forming photographic cyan images and, in particular, may be incorporated into silver halide color photographic materials.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support thereon having at least one red-sensitive silver halide emulsion layer containing at least one cyan coupler which forms a cyan dye having a maximum absorption peak wavelength of from 605 to 700 nm of the general formula (I):

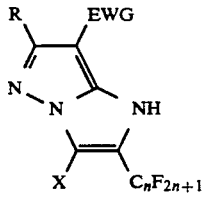

(I)

where

R represents a substituent group;

EWG represents an electron-attaching group having a $\sigma_p$ of 0.30 or more and which does not substantially split off from the formula on reaction of the coupler with an oxidation product of an aromatic primary amine developing agent;

X represents a hydrogen atom or a releasable group which splits off from the formula on reaction of the coupler with an oxidation product of an aromatic primary amine developing agent; and n represents an integer of from 1 to 7.

2. The silver halide color photographic material as in claim 1, wherein R is a heterocyclic group, a cyano group, an alkoxy group, an aryloxy group, a heterocyclic-oxy group, an aliphatic or aromatic acyloxy group, a carbamoyloxy group, a silyloxy group, an aliphatic or aromatic sulfonyloxy group, an aliphatic or aromatic acylamino group, an anilino group, a ureido group, a sulfamoylamino group, an alkylthio group, an arylthio group, a heterocyclic-thio group, an alkoxycarbonylamino group, an aryloxycarbonylamino group, a sulfonamido group, a carbamoyl group, an aliphatic or aromatic acyl group, an aliphatic or aromatic sulfonyl group, a sulfinyl group, an alkoxycarbonyl group, an aryloxycarbonyl group or an aromatic group.

3. The silver halide color photographic material as in claim 1, wherein X is a hydrogen atom; a halogen atom; an aromatic azo group; a group bonded to an aliphatic group, an aromatic group, a heterocyclic group, an aliphatic, aromatic or heterocyclic sulfonyl group, or an aliphatic, aromatic or heterocyclic carbonyl group through an oxygen, nitrogen, sulfur or carbon atom; or a heterocyclic group bonded to the coupling position of the formula via a nitrogen atom of the group.

4. The silver halide color photographic material as in claim 1, wherein EWG of the electron-attracting group having a $\sigma_p$ of 0.30 or more is a cyano group, a nitro group, an aliphatic or aromatic acyl group, a carbamoyl group, a phosphono group, an alkoxycarbonyl group, a phosphoryl group, an aliphatic or aromatic sulfamoyl group, an aliphatic or aromatic sulfonyl group or a fluoroalkyl group.

5. The silver halide color photographic material as in claim 4, wherein EWG is a cyano group, a carbamoyl group, an alkoxycarbonyl group, an aliphatic or aromatic acyl group, an aliphatic or aromatic sulfonyl group or a sulfamoyl group.

6. The silver halide color photographic material as in claim 1, wherein n in formula (I) is an integer of from 1 to 3.

7. The silver halide color photographic material as in claim 1, wherein the cyan coupler of the formula (I) is present in an amount of from $1\times10^{-3}$ mol to 1 mol per mol of silver halide in the layer.

* * * * *